United States Patent [19]

Yashiki

[11] Patent Number: 4,657,835

[45] Date of Patent: Apr. 14, 1987

[54] ELECTROPHOTOGRAPHIC PHOTOSENSITIVE MEMBER HAVING AN INTERMEDIATE LAYER OF CONDUCTIVE POWDER AND RESIN OR OLIGIMER

[75] Inventor: Yuichi Yashiki, Yokohama, Japan

[73] Assignee: Canon Kabushiki Kaisha, Tokyo, Japan

[21] Appl. No.: 739,067

[22] Filed: May 29, 1985

[30] Foreign Application Priority Data

May 31, 1984 [JP] Japan ..... 59-109684
Nov. 5, 1984 [JP] Japan ..... 59-232851

[51] Int. Cl.[4] ..... G03G 5/14

[52] U.S. Cl. ..... 430/60; 430/63; 430/65

[58] Field of Search ..... 430/64, 63, 69, 65, 430/60

[56] References Cited

U.S. PATENT DOCUMENTS 3,975,195 8/1976 Goffe ..... 430/60
4,106,935 8/1978 Petruzzella ..... 430/64

*Primary Examiner*—John L. Goodrow
*Attorney, Agent, or Firm*—Fitzpatrick, Cella, Harper & Scinto

[57] ABSTRACT

An electrophotographic photosensitive member having at least a substrate, a photosensitive layer, and an intermediate layer therebetween, characterized in that the intermediate layer is a hardened coating film formed from a liquid dispersion comprising (a) an electro-conductive powder and (b) a composition which contains either a resin or an oligomer and a crosslinking agent and is liquid at ordinary temperature in the absence of solvent.

51 Claims, 2 Drawing Figures

ELECTROPHOTOGRAPHIC PHOTOSENSITIVE MEMBER HAVING AN INTERMEDIATE LAYER OF CONDUCTIVE POWDER AND RESIN OR OLIGIMER

BACKGROUND OF THE INVENTION

1. Field of the Invention

The present invention relates to an electrophotographic photosensitive member having an intermediate layer.

2. Description of the Prior Art

Basically an electrophotographic photosensitive member is constructed of a substrate and a photosensitive layer. However, it is effective to interpose an intermediate layer between the substrate and the photosensitive layer, for enhancing the adhesion of the photosensitive layer to the substrate, improving the workability of coating which forms the photosensitive layer, protecting the substrate, covering defects on the substrate, protecting the photosensitive layer from electric breakdown, improving the ability to inject an electric charge from the substrate into the photosensitive layer, and so forth.

It has hitherto been known that the intermediate layer may be prepared of poly(vinyl alcohol), poly(vinyl methyl ether), poly-N-vinylimidazole, ethylcellulose, methylcellulose, ethylene-acrylic acid copolymer, casein, gelatin, polyamide, or the like.

Electrical properties are cited as primary examples of the properties required for the intermediate layer. Since this layer is used in an electrophotographic photosensitive member, it is important that the layer has no adverse effect on the electrophotographic characteristics of the photosensitive member. Therefore the electric resistance of the layer needs to be low. If the resistance is high, potential will be applied to a subbing layer when the photosensitive member is electrically charged, and this may cause so-called fogging, as one effect of the residual potential on the image.

Further, the electric resistance is required to be unaffected by environmental changes, particularly by the change in atmospheric humidity. For instance, when the electric resistance is raised with a decrease in atmospheric humidity, fogging will be caused.

In order to cover defects on the substrate, the intermediate layer is also required to have such a coating property as to hide the defects effectively. That is, the intermediate layer needs to produce no defect unto itself that are traceable to a defect on the substrate. The intermediate layer, when defects on the substrate are projections, needs to cover and hide them with its own surface kept flat and smooth and when defects on the substrate are hollows, needs to fill up and hide them similarly.

Although such properties as mentioned above are required for the intermediate layer, these requirements have not been fulfilled with the prior art intermediate layer composed of a single resin.

SUMMARY OF THE INVENTION

An object of the invention is to provide an electrophotographic photosensitive member having an intermediate layer which has a low electric resistance insusceptible to environmental changes which sufficiently hide possible defects on the substrate.

Another object of the invention is to provide an electrophotographic photosensitive member produced easily at a low cost using a coarse surface substrate.

According to one aspect of the present invention, there is provided an electrophotographic photosensitive member having at least a substrate, a photosensitive layer, and an intermediate layer therebetween, characterized in that the intermediate layer is a hardened coating film. The coating film is itself formed from a liquid dispersion comprising (a) an electro-conductive powder and (b) a composition which contains either a resin or an oligomer and a crosslinking agent and is liquid at ordinary temperature in the absence of a solvent.

According to another aspect of the present invention, there is provided an electrophotographic photosensitive member for an electrophotographic device provided with a laser as a light source, said photosensitive member comprising a substrate having reflective surface, a photosensitive layer, and an intermediate layer interposed therebetween, characterized in that the intermediate layer is a hardened coating film formed from a liquid dispersion comprising (a) an electro-conductive powder and (b) a composition which contains either a resin or an oligomer and a crosslinking agent and is liquid at ordinary temperature even in the absence of solvent.

According to further aspect of the present invention, there is provided an electrophotographic photosensitive member having at least a substrate, a photosensitive layer, and an intermediate layer therebetween, characterized in that the intermediate layer is a hardened coating film formed from a dispersion liquid comprising (a) an electro-conductive powder, (b) an acrylate or methacrylate oligomer, and (c) a compound having an acryloyloxy or methacryloyloxy group and a carboxyl group.

According to still further aspect of the present invention, there is provided an electrophotographic photosensitive member for an electrophotographic device provided with a laser as light source, said photosensitive member comprising a substrate having reflective surface, a photosensitive layer, and an intermediate layer interposed therebetween, characterized in that the intermediate layer is a hardened coating film formed from a liquid dispersion comprising (a) an electro-conductive powder, (b) an acrylate or methacrylate oligomer, and (c) a compound having an acryloyloxy or methacryloyloxy group and a carboxyl group.

DETAILED DESCRIPTION OF THE INVENTION

Figure 1:
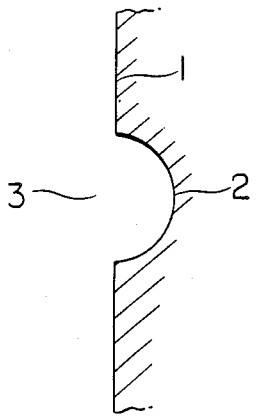
FIG. 1 is an illustration showing a state of an intermediate coating layer which has been applied on a substrate having a surface defect (hollow).

Resins, oligomers, and compositions which are liquid at ordinary temperature in the absence of solvent in the invention have viscosities of from 50 to $1\times10^5$ mPsec (milli-Pascal second) as measured at 20° C. with a rotational viscometer (supplied by Shibaura System Co., Ltd. under the tradename of Vismetron Model VS-AI). For coating the substrate, the resin or oligomer may or may not be dissolved in a solvent for coating, that is, surface defects in the substrate can be effectively hidden as described later by using the resin or oligomer as either a solvent-dissolved type of coating liquid or a non-solvent type of coating liquid.

In one embodiment of the invention, the intermediate layer laid between the substrate and the photosensitive layer is a hardened coating film formed from a liquid dispersion comprising (a) an electro-conductive powder and (b) a composition which contains the above-mentioned resin or oligomer and is liquid at ordinary temperature in the absence of solvent. In a preferred embodiment of the invention, the resin or oligomer used is liquid at ordinary temperature even in the absence of solvent.

Generally, suitable organic solvents for use in the coating material containing the above-mentioned resin are, for example: alcohols such as methanol, ethanol, and isopropanol; ketones such as acetone, methyl ethyl ketone, and cyclohexanone; amides such as N,N-dimethylformamide and N,N-dimethylacetamide; sulfoxides such as dimethylsulfoxide; ethers such as tetrahydrofuran, dioxane, and ethylene glycol monomethyl ether; esters such as methyl acetate and ethyl acetate; halogenated aliphatic hydrocarbons such as chloroform, methylene chloride, dichloroethylene, carbon tetrachloride, and trichloroethylene; and aromatics such as benzene, toluene, xylene, ligroin, monochlorobenzene, and dichlorobenzene.

Requirements for the intermediate layer of the invention are (1) to be capable of hiding the defect with itself formed relatively thick, (2) to have high filling effect on the hollow defect, (3) to have sufficient resistance to the solvent in the coating material to be applied thereon, and (4) to adhere strongly to the substrate.

In order to fulfill requirement (1), the electric resistance of the intermediate layer must be low. Therefore an electro-conductive powder (a) is dispersed in the intermediate layer in the invention.

In order to fulfill requirement (2), the volume shrinkage of the coated material upon forming a coated film must be low. If the coating material 3 applied to fill the defect 2 of the substrate 1 as shown in FIG. 1 decreases in volume on account of the solvent evaporation or other effect during film formation, the volume of the coated material in the defect 2 will also decrease as shown in FIG. 2 and hence the defect-filling effect will be poor.

Figure 2:
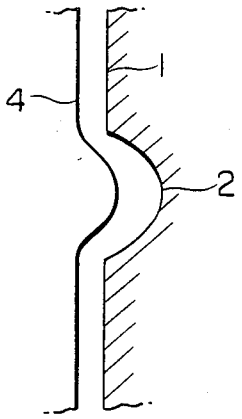
FIG. 2 is an illustration showing a state of a coated layer covering insufficiently a similar defect on shrinkage of the applied coating material.

In contrast, when the resin is liquid, the applied coating material still remains liquid after evaporation of the solvent (no change occurs in the case of a non-solvent type of coating material) and therefore, the resin still shows fluidity and hence can maintain the state of FIG. 1.

For the purpose of satisfying requirement (3), thermosetting resins are suited for use in the coating material. Such resins include, for example, epoxy resin, urethane resin, and acrylate oligomer.

The resin for use in the invention which is liquid at ordinary temperature includes also, for example, a thermosetting resin in the composition comprising a main chemical (resin) and a hardener, where one of the main chemical and hardener is not liquid in the separate state but the mixture of the two, i.e. the composition itself, is liquid. Suitable viscosities of this liquid composition are also in the range of 50 to $1\times10^5$ m Psec.

Electro-conductive powders that can be used to lower the electric resistance of the intermediate layer include, for example, powders of metals such as aluminum, nickel, copper, and silver, powders of alloys of these metals, carbon powder, antimony oxide-containing tin oxide powder, other powder surface-coated with such tin oxide, and powders of conductive zinc oxide, lead oxide, and iron oxide. In the case of electrophotographic photosensitive members, little electric current flows therethrough. Therefore a resistivity of the powder of about $10^5$ Ωcm or less is adequate. The particle size of the powder is desired to be 1μ or less.

When the sensitivity of the electrophotographic photosensitive member is intended to be increased by utilizing the reflected light from the intermediate layer, pale color powders are preferred to black powders like carbon black; in particular, antimony oxide-containing tin oxide powder is suited. For the purpose of cost reduction of the conductive powder or for the purpose of improving the dispersibility and free-flow as powder, it is advisable to use a powder of titanium oxide, zinc oxide, calcium carbonate, aluminum oxide, barium sulfate, or barium carbonate of which surface is coated with a tin oxide containing antimony oxide.

An insulating pigment may be mixed into the conductive powder unless the conductivity is detracted. This is especially suited for improvements of the coating material in color tone, dispersibility, and coating workability and for reduction of the coating material cost.

The weight ratio of the conductive powder to the resin or oligomer ranges from about 5:1 to about 1:5. The ratio is properly chosen by considering the electric resistance and surface properties of the intermediate layer and application property of the resulting coating material.

For dispersing the powder, a usual means such as a ball mill, roll mill, sand mill, or attritor can be used. For the purpose of improving the dispersibility and coating workability, a surfactant, silane coupling agent, titanate coupling agent, silicone oil, and silicone leveling agent may be added to the coating material.

Then the coating material is applied on the substrate, and hardened to form the intermediate layer. The thickness of the intermediate layer is approximately from 1 to 30μ. Since the coating material retains the fluidy after vaporization of the solvent, surface hollow defect of the substrate can be filled up with the coated material as shown in FIG. 1 even after the hardening of the coated material.

In another embodiment of the invention, the intermediate layer laid between the substrate and the photosensitive layer is a hardened coating film formed from a composition comprising (a) an electroconductive powder, (b) an acrylate oligomer or methacrylate oligomer [hereinafter referred to as (meth)acrylate oligomer], and (c) a compound having an acryloyloxy or methacryloyloxy group [hereinafter referred to as (meth)acryloyloxy group]and a carboxyl group. This hardened coating film is capable of satisfying requirements (1) through (4). In particular, the compound having a (meth)acryloyloxy group and a carboxyl group is best suited in satisfying requirement (4). The (meth)acryloyloxy group $CH_2{=}CR{-}COO{-}$(acryloyloxy group when R is —H; methacryloyloxy group when R is $-CH_3$) causes copolymerization of this compound with the (meth) acrylate oligomer into a single body during the hardening. The carboxyl group —COOH has reactivity for metal surfaces or activates metal surfaces, enforcing the adhesion.

The following are structural formulae of typical examples of the compound having a (meth) acryloyloxy group and a carboxyl group.

$$CH_2{=}CR{-}COOH \quad (a)$$

(b)

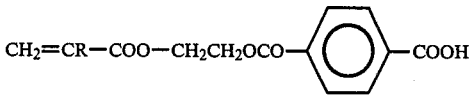

$$CH_2{=}CR{-}COO{-}CH_2CH_2OCO{-}\bigcirc{-}COOH$$

$$CH_2{=}CR{-}COO{-}CH_2CH_2OCO{-}COOH \quad (c)$$

(d)

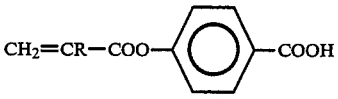

$$CH_2{=}CR{-}COO{-}\bigcirc{-}COOH$$

$$CH_2{=}CR{-}COO{-}CH_2CH_2{-}COOH \quad (e)$$
$$CH_2{=}CR{-}COO{-}CH_2CH_2OCOCH_2CH_2{-}COOH \quad (f)$$

Suitable mixing ratios (%) of the compound having a (meth)acryloyloxy group and a carboxyl group to the (meth)acrylate oligomer are 1 to 50%, particularly 5 to 40%, by weight. When the ratio is less than 1%, the adhesion effect will not be obtained, and when the ratio exceeds 50%, the curability and strength of the coat will be low. Therefore the ratio is minimized as far as the sufficient adhesion is obtained.

The conductive powder used in this embodiment include, for example, powders of metals such as aluminum, nickel, copper, and silver, powders of alloys of these metals, carbon powder, antimony oxide-containing tin oxide powder, other-material powder surface-coated with such tin oxide, and powders of conductive zinc oxide, lead oxide, and iron oxide. In the case of electrophotographic photosensitive members, not much electric current flows therethrough. Therefore a resistivity of the powder of about $10^5$ Ωcm or less is adequate. The particle size of the powder is desired to be 1μ or less.

The (meth)acrylate oligomer of an ester of acrylic acid $CH_2{=}CH{-}COOH$ or methacrylic acid $$CH_2{=}\underset{\underset{CH_3}{|}}{C}{-}COOH.$$

Having a double bond, this ester oligomer can be polymerized and hardened by the action of a polymerization initiator. While the following description is on the methacrylate oligomer, the same applies to the acrylate oligomer.

Since the methacrylate oligomer is used for the coating material, the monoester oligomer is used not singly but jointly with a polyester oligomer because the monoester of oligomer itself is hard to cure. Oligomers of diesters, triesters, and tetraesters are chiefly used. Examples of the monoester used are methyl methacrylate, methoxydiethylene glycol methacrylate, methoxytetraethylene glycol methacrylate, and methoxypolyethylene glycol methacrylate. Examples of the diester are ethylene glycol dimethacrylate, diethylene glycol dimethacrylate, triethylene glycol dimethacrylate, polyethylene glycol dimethacrylate, 1,3-butylene glycol dimethacrylate, 1,4-butylene glycol dimethacrylate, 1,6-hexane glycol dimethacrylate, neopentyl glycol dimethacrylate, dipropylene glycol dimethacrylate, polypropylene glycol dimethacrylate, 2,2'-bis(4-methacryloxydiethoxyphenyl)propane, and 2,2'-bis (4-methacryloxypropoxyphenyl)propane. Examples of the triester are trimethylolpropane trimethacrylate, trimethylolethane trimethacrylate, and tetramethylolmethane trimethacrylate, and an example of the tetraester is tetramethylolmethane tetramethacrylate. Additional examples of the effective oligomer are an epoxymethacrylate oligomer prepared by combining methacrylic acid with the terminal epoxy group of a backbone epoxy resin, a polyester methacrylate oligomer prepared by combining methacrylic acid with the terminal hydroxyl group of a backbone polyester resin, and a polyurethane methacrylate oligomer prepared by combining methacrylic acid with the terminal isocyanate group or hydroxyl group of a backbone polyurethane resin. Suitable molecular weights of these oligomers are up to $1\times10^4$ in view of the fluidity. These oligomers are favorable for improving the dispersibility of the conductive powder. All the oligomers can be used alone or in combination.

When the coat to form the intermediate layer is electrocurable, no polymerization initiator is necessary. For the thermosetting, a polymerization initiator selected from various peroxides, azobisnitrile compounds, and diazonium salts is added to the coating material. For the photocure, a polymerization initiator selected from benzoin ethers, benzophenone and derivatives thereof, and anthraquinone and derivatives thereof is added to the coating material. The amount of polymerization initiator added is from 1 to 5% by weight.

Also in this embodiment, a surfactant, silane coupling agent, titanate coupling agent, silicone oil, or silicone leveling agent may be added to the coating material.

The weight ratio of the conductive powder to the (meth)acrylate oligomer ranges from 5:1 to 1:5. The ratio is properly chosen by considering the electric resistance and surface properties of the intermediate layer and application property of the resulting coating material.

For dispersing, a usual means such as a ball mill, roll mill, sand mill, or attritor can be used. For the purpose of improving application property and dispersability, a little amount of a solvent may be added.

After this dispersion treatment, a suitable amount of (meth)acrylate oligomer may be added to adjust the viscosity. The compound having a (meth) acryloyloxy group and a carboxyl group may be added either before or after said dispersion treatment.

Then the resulting coating material is applied on the substrate and then hardened to form the intermediate layer. The thickness of the intermediate layer is approximately from 1 to 30μ. Since this coating material also retains fluidity after vaporization of the solvent, hollow defects on the substrate can be filled up with the coating material as shown in FIG. 1.

Depending upon the component materials of the photosensitive layer formed on the intermediate layer, free carriers may be injected from the intermediate layer into the photosensitive layer. If such a phenomenon develops, the potential decay of the photosensitive layer will be remarkable and this will make the image formation difficult. However, this free carrier injection can be prevented by forming further a second thin resin layer containing no conductive powder on the intermediate layer containing the conductive powder. This second resin layer can be formed from a resin commonly used for the conventional intermediate layer. Among various resins, polyamide resin and phenolic resin are favorable in view of the coating workablility, resistivity, and resistance to the solvent which will be used to form the photosensitive layer. Of polyamide resins, linear polyamides are preferred. In particular, copolymerized nylon and/or type 8 nylon, which is low crystalline or amorphous, is best suited in that these can be applied in the form of solution. Each nylon is dissolved in alcohol such as methanol, ethanol, or butanol For stabilizing the solution, an aromatic hydrocarbon such as toluene or xylene may be added. The thickness of this polyamide resin layer is of the order of 0.1 to 2μ. If the thickness is inadequate, defects will tend to appear on the coating. The thickness, if excessive, will cause the residual potential.

The phenolic resin that can be used in lieu of the polyamide resin is preferably an alcohol-soluble one of resol type, which is prepared by the reaction of phenol and formalin in the presence of an alkali catalyst. If it is necessary to lower the curing temperature, an organic acid such as benzenesulfonic acid, toluenesulfonic acid, phenolsulfonic acid, or naphthalenesulfonic acid in an amount of 10 to 20% by weight is added as a hardener. The phenolic resin and if necessary, the hardener is applied to a final thickness of 0.5 to 10μ and then hardened at about 150° C.

The electrophotographic photosensitive member according to the present invention is made by overlaying the substrate in turn with the intermediate layer, the layer of the above-mentioned polyamide, phenolic resin or the like if necessary, and the photosensitive layer.

The photosensitive layer is formed by applying a coating material comprising a photoconductive substance such as a colorant-sensitized zinc oxide, selenium, amorphous silicon powder, polyvinylcarbazole, phthalocyanine pigment, or oxadiazole pigment, and if necessary, a binder.

When an organic photoconductive material is used, two photosensitive layers, a charge generation layer capable of generating charge carriers on light exposure and a charge transport layer capable of transporting the generated charge carriers may be combined for improving characteristics.

The charge generation layer is formed of a charge-generating material dispersed in a binder resin. Suitable charge-generating materials are, for example, azo pigments such as Sudan Red and Dian Blue, disazo pigments, quinone pigments such as Algol Yellow and pyrenequinone, quinocyanine pigments, perylene pigments, indigo pigments such as indigo and thioindigo, bisbenzoimidazole pigments, phthalocyanine pigments such as copper-phthalocyanine, quinacridone pigments, pyrylium dyes, and azulenium salts. Sutable binder resins are, for example, polyester, poly(vinyl acetate), acrylic resin, poly(vinyl butyral), polyvinylpyrrolidone, methylcellulose, hydroxypropylmethylcellulose, and cellulose ester. The charge generation layer can also be formed by the vapor deposition method or the like. The thickness of the charge generation layer is of the order of 0.05 to 0.2μ.

The charge transport layer is formed from a hole-transporting material dissolved, if necessary, together with a film-forming resin in a solvent. Examples of the hole-transporting material include compounds having, as main chain or side chain, a polycyclic aromatic structure such as anthracene, pyrene, phenanthrene, or coronene, or a nitrogen-containing cyclic structure such as indole, carbazole, oxazole, isoxazole, thiazole, imidazole, pyrazole, oxadiazole, pyrazoline, thiadiazole, or triazole; and hydrazone compounds. The film-forming resin is used since the charge-transporting material itself is deficient in the film-forming property when the material is a low molecular compound. Suitable film-forming resins include, for example, polycarbonate, polyarylate, polystyrene, polymethacrylate, styrene-methyl methacrylate copolymer, polyester, styrene-acrylonitrile copolymer, and polysulfone. The thickness of the charge transport layer is of the order of 5 to 20μ.

The electrophotographic photosensitive member of the present invention has been fabricated at a greatly reduced cost for working the subsqrate because the surface of the substrate, e.g. a cylindrical aluminum, is allowed to be coarse. As will be illustrated later in Examples, the intermediate layer was highly effective in forming good quality images and in eliminating undesirable effects of substrate surface defects. In addition, the electrophotographic photosensitive member according to the present invention is effective for use in a so-called laser beam printer and the like, wherein a laser beam is employed as light source, since the resin layer (intermediate layer) containing a dispersed powder is laid under the photosensitive layer and has the effect of scattering incident light at the surface thereof, thus preventing the multiple interference in the photosensitive layer occurred by the laser light reflected from the reflective surface of the substrate having a reflective surface.

The invention is illustrated in more detail with reference to the following examples.

In the examples, surface defects (hollows) of the substrate and those of the intermediate layer were measured by using a "Universal Surface State Tester SE-3C" supplied by Kosaka Laboratory Co., Ltd.

EXAMPLE 1

An aluminum cylinder (60ϕ×260 mm) having a hollow of 100μ in maximum width and 10μ in depth at the surface was used as substrate.

On the other hand, a titanium oxide powder (100 parts by weight) (hereinafter parts are all by weight) coated with tin oxide (75 wt % based on the titanium oxide) containing antimony oxide (10 wt % based on the total weight of tin oxide and antimony oxide) was incorporated into a solution composed of an epoxy resin (90 parts, supplied by Dainippon Ink And Chemicals, Inc. under the tradename of Epichlon 850), 2-methoxyethanol (30 parts), methyl ethyl ketone (20 parts), and a surfactant (1 part, supplied by Asahi Denka Co., Ltd. under the tradename of SO-105). The mixture was then ball-milled for 5 hours to form a dispersion.

To this dispersion was added triethylenetetramine (9 parts) as a hardener. Both the epoxy resin and the hardener used in this example are viscous liquids.

The coating material thus prepared was applied on the substrate, and heated at 110° C. for 1 hour to form a 25-μ thick intermediate layer. The depth of the hollow filled with the intermediate layer material was found to be 1μ, which was 1/10 of the original depth of the hollow. The viscosity of Epichlon 850 used in this example was 12,000 mPsec, as measured by the above-mentioned method.

A coating solution of a polyamide resin (2 parts, supplied by Toray Industries, Inc. under the tradename of Amylan CM8000) and an 8-nylon resin (2 parts supplied by Teikoku Kagaku Co., Ltd. under the tradename of Toresin EF30T) in a mixture of methanol (50 parts) and toluene (45 parts) was applied on the intermediate layer by the dip coating method to form a 0.7-μ thick resin layer.

Then a disazo pigment (10 parts) of the structural formula

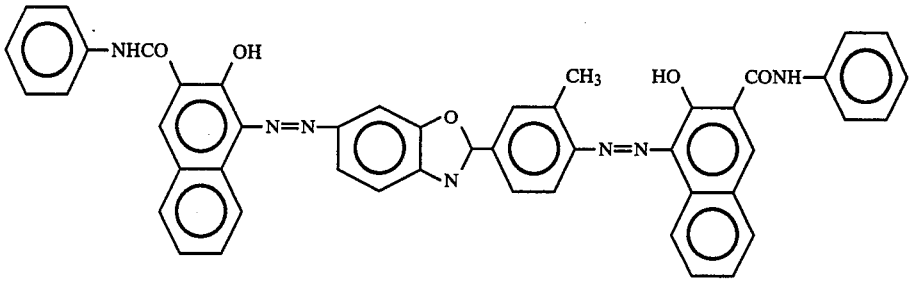

and a cellulose acetate butyrate resin (6 parts, supplied by Eastman Chemical Products, Inc. under the tradename of CAB-381) with cyclohexanone (60 parts) were ground for 20 hours in a sand mill using 1-mmϕ glass beads. The resulting dispersion, mixed with methyl ethyl ketone (100 parts), was applied on the polyamide resin layer by the dip coating method, and dried by heating at 100° C. for 10 minutes to form a charge generation layer of 0.1 g/m$^2$ in coating weight.

Then a hydrazone compound (10 parts) of the structural formula

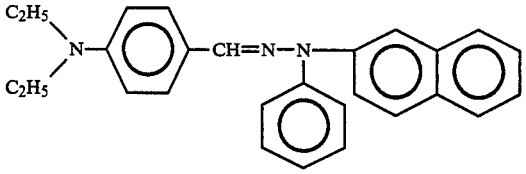

and a styrene-methyl methacylate copolymer resin (15 parts, supplied by Shinnittetsu Kagaku Co., Ltd. under the tradename of MS200) were dissolved in toluene (80 parts). The resulting solution was applied on the charge generation layer and dried in a stream of hot air at 100° C. for 1 hour to form a 16-μ thick charge transport layer, thus completing an electrophotographic photosensitive member [designated as sample (1)].

For comparison the following photosensitive members were prepared.

Sample (2) . . . The photosensitive layer was formed directly on the substrate without forming any intermediate layer or any polyamide resin layer.

Sample (3) . . . The intermediate layer was formed on the substrate and the photosensitive layer was formed directly on the intermediate layer.

Sample (4) . . . The polyamide resin layer was formed directly on the substrate without forming any intermediate layer, and the photosensitive layer was formed on the polyamide resin layer.

These photosensitive members were tested by using an electrophotographic copying machine to evaluate the resulting image quality. The results were as follows: Images given by samples (2) and (4) were rough in quality and affected by substrate defects; images given by sample (3) showed very low density; in contrast, images given by sample (1) were good, showing no defect.

COMPARATIVE EXAMPLE 1

In the same manner as used in Example 1, the following coating liquid prepared to form an intermediate layer for comparison was applied on a substrate (having a hole of 100μ in maximum width and 10μ in depth at the surface) similar to the one used in Example 1.

Coating liquid for comparison:

| Coating liquid for comparison: | |
|---|---|
| Main chemical: Acrylic resin (Acrydek A405: Dainippon Ink And Chemicals, Inc.) | 73 parts |
| Hardener: Melamine resin (Super Beckamine L121-60: Dainippon Ink And Chemicals, Inc.) | 18 parts |
| 2-Methoxyethanol | 30 parts |
| Methyl ethyl ketone | 20 parts |
| Surfactant (SO-105: Asahi Denka Co., Ltd.) | 1 part |
| Titanium oxide powder (the same as used in Example 1) | 100 parts |

The surface state of the resulting intermediate layer was examined with the result that a hollow of 100μ in maximum width and 5μ in depth was observed.

Then, the same polyamide resin layer, charge generation layer, and charge transport layer as formed in Example 1 were formed successively, thus completing a photosensitive member. Images reproduced by setting this photosensitive member in an electrophotographic copying machine, and operating the machine. On the resulting copy, a number of black dots were observed which seemed to correspond to defects (hollows) at the substrate surface.

The acrylic resin (4 parts) and the melamine resin (1 part), used in this comparative example, were mixed, but did not become liquid.

COMPARATIVE EXAMPLE 2

Tests were made in the same manner as used in Comparative Example 1 but using an alkyd resin (Beckosol 1344; Dainippon Ink And Chemicals, Inc.) in place of the acrylic resin. Results similar to those of Comparative Example 1 were obtained.

COMPARATIVE EXAMPLE 3

Tests were made in the same manner as used in Example 1 but using a solid epoxy resin (Epikote 1004; Shell Chemical Co.) in place of the liquid epoxy resin (Epichlon 850; Dainippon Ink And Chemicals, Inc.).

At the surface of the formed intermediate layer, a hole of 100μ in maximum width and 6μ in depth was observed. In the image-forming test, a number of black dots were observed similarly to Comparative Example 1 on the resulting copy. The solid epoxy resin and the hardener triethylenetetramine were mixed together but did not become liquid.

EXAMPLE 2

The same conductive powder (100 parts) as used in Example 1, was ball-milled together with a polyol for urethane paint (22 parts, supplied by Nippon Polyurethane Co., Ltd. under the tradename of Nippolane 1100), 2-methoxyethanol (30 parts), and a silane coupling agent (1 part, supplied by Toray Silicone Co., Ltd. under the tradename of SH6020). To the resulting dispersion liquid was added an isocyanate for urethane paint (20 parts, supplied by Nippon Polyurethane Co., Ltd. under the tradename of Coronate EH) to make up an urethane coating material. Both the polyol and the isocyanate used were liquid. This coating material was applied on a substrate similar to the one used in Example 1, and was heated at 120° C. for 1 hour to form a 25-μ thick intermediate layer. The depth of a hollow which was present at the substrate surface was found to be 1μ, which was 1/10 of the original depth of the hole. The viscosity of the Nippolane 1100 (main chemical)—Coronate EH (hardener) mixed liquid was 5000 mPsec, as measured by the above-mentioned method.

A similar electrophotographic photosensitive member could be obtained by overlaying the intermediate layer successively with the same polyamide layer, charge generation layer, and charge transport layer as formed in Example 1.

EXAMPLE 3

An electrophotographic photosensitive member was prepared by following the procedure of Example 1 except that a coating solution composed of a phenolic resin (100 parts, supplied by Dainippon Ink And Chemicals, Inc. under the tradename of Priofen 5010), p-toluenesulfonic acid (7 parts), and ethanol (70 parts) was applied, in lieu of the polyamide-containing coating solution used in Examples 1 and 2, on the intermediate layer, and was heated at 100° C. for 10 minutes to form a 6-μ thick phenolic resin layer. The obtained photosensitive member showed similar good characteristics.

EXAMPLE 4

An aluminum cylinder (60ϕ×260 mm) having a hollow of 100μ in maximum width and 10μ in depth at the surface was used as substrate.

On the other hand, a titanium oxide powder (100 parts) coated with tin oxide (75 wt % based on the titanium oxide) containing antimony oxide (10 wt % based on the total weight of tin oxide and antimony oxide) was incorporated into a solution composed of a polyacrylate oligomer of polyol (50 parts, supplied by Toa Gosei Co., Ltd. under the tradename Aronix 8060) and 1,6-hexane glycol diacrylate (80 parts). The mixture was ball-milled to disperse the powder thoughly. Then the compound (8 parts) of formula (e), aforementioned as an example of the compound having a (meth)acryloyloxy group and a carboxyl group, and benzoyl peroxide (6 parts) were dissolved in methyl ethyl ketone (30 parts). This solution was mixed with the above dispersion to make up a coating material for the intermediate layer. This coating material was applied on the substrate, and hardened by heating at 130° C. to form a 17-μ intermediate layer.

A solution of a polyamide resin (Amylan CM8000, 2 parts) and an 8-nylon resin (Toresin EF30T, 2 parts) in a mixture of methanol (50 parts) and toluene (45 parts) was applied on the intermediate layer by the dip coating method to form a 0.7-μ thick resin layer.

Then a disazo pigment (10 parts) of the structural formula

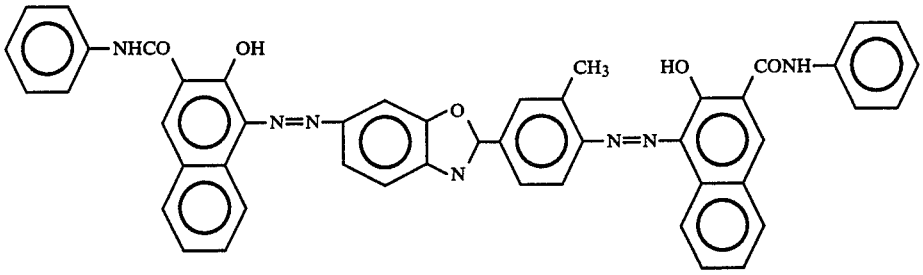

and a cellulose acetate butyrate resin (CAB-381, 6 parts) with cyclohexanone (60 parts) were ground for 20 hours in a sand mill using 1-mmϕ glass beads. The resulting dispersion was mixed with methyl ethyl ketone (100 parts), and applied on the polyamide resin layer by the dip coating method, and dried by heating at 100° C. for 10 minutes to form a charge generation layer of 0.1 g/m$^2$ in coating weight.

Then a hydrazone compound (10 parts) of the structural formula

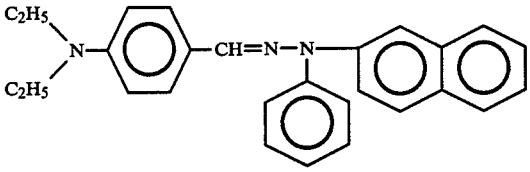

and a styrene-methyl methacrylate copolymer (MS200, 15 parts) were dissolved in toluene (80 parts). The resulting solution was applied on the charge generation layer and dried in a stream of hot air at 100° C. for 1 hour to form a 16-μ thick charge transport layer, thus completing an electrophotographic photosensitive member [designated as sample (1')].

For comparison the following photosensitive member were prepared.

Sample (2') . . . The intermediate layer was formed directly on the substrate without forming any intermediate layer or any polyamide resin layer.

Sample (3') . . . The intermediate layer was formed on the substrate, and the photosensitive layer was formed directly on the intermediate layer.

Sample (4') . . . The polyamide resin layer was formed directly on the substrate without forming any intermediate layer, and the photosensitive layer was formed on the polyamide resin layer.

These photosensitive members were tested by using an electrophotographic copying machine to evaluate the resulting image quality. The results were as follows: Images given by samples (2') and (4') were rough in quality and affected by substrate defects; images given by sample (3') showed very low density; in contrast, images given by sample (1') were good, showing no defect. Inspection of that portion of the intermediate layer surface of sample (1') which corresponded to the position of the hollow at the substrate surface showed that the hollow was sufficiently hidden.

EXAMPLE 5

The same pigment (100 parts) as used in Example 4 was dispersed in a mixture of trimethylolpropane trimethacrylate (40 parts), an epoxyacrylate (40 parts, supplied by Dainippon Ink And Chemicals, Inc. under the tradename of V5502), and the compound (10 parts) of formula (b), aforementioned as an example of the compound having a (meth)acryloyloxy group and a carboxyl group, by means of a ball mill.

The resulting dispersion was applied by spray coating on the same substrate as used in Example 4, and hardened by electron beam irradiation using a Ford type of scanning electron beam irradiator (acceleration voltage 270 KV, current 65MA, irradiation period 15 sec, dose 60 Mrad). Thus a 7-$\mu$ thick intermediate layer was formed. In this case, no polymerization initiator was necessary since the hardening was carried out by electron beam irradiation.

The intermediate layer was overlaid successively with the same polyamide resin layer, charge generation layer, and charge transport layer as formed in Example 4. The thus prepared electrophotographic photosensitive member gave also good reproduced images.

EXAMPLE 6

A conductive zinc oxide powder (100 parts, supplied by Honso Chemical Co., Ltd.) was dispersed in a mixture of tetramethylolmethane tetracrylate (40 parts), diethylene glycol dimethacrylate (30 parts), and the compound (8 parts) of formula (e), aforementioned as an example of the compound having a (meth)acryloyloxy group and a carboxyl group, by means of a ball-mill. The resulting dispersion, mixed with lauroyl peroxide (2.8 parts), was used as coating material, forming an intermediate layer in the same manner as in Example 4. In this case, also a good electrophotographic photosensitive member was obtained.

EXAMPLE 7

An electrophotographic photosensitive member was prepared by following the procedure of Example 4 except that a 6-$\mu$ thick phenolic resin layer was formed on the intermediate layer from a coating solution composed of a phenolic resin (100 parts, Priofen 5010), p-toluenesulfonic acid (7 parts), and ethanol (70 parts), in lieu of the polyamide resin-containing solution used in Examples 4–6, by dip coating, and heating the coat at 100° C. for 10 minutes. The obtained photosensitive member was found to have similar characteristics.

What is claimed is:

1. An electrophotographic photosensitive member having at least a substrate, a photosensitive layer, and an intermediate layer therebetween, characterized in that the intermediate layer is a hardened coating film formed from a liquid dispersion comprising (a) an electro-conductive powder adaptive to lower the electrical resistance of the intermediate layer and (b) a composition which contains either a resin or an oligomer and a crosslinking agent and is liquid at ordinary temperature in the absence of solvent.

2. The electrophotographic photosensitive member of claim 1, wherein the viscosity of the composition which is liquid at ordinary temperature is in the range of from 50 to $1\times10^5$ m P sec.

3. The electrophotographic photosensitive member of claim 1, wherein said resin or oligomer is liquid at ordinary temperature in absence of solvent.

4. The electrophotographic photosensitive member of claim 1, wherein the viscosity of said resin or oligomer is in the range of from 50 to $1\times10^5$ m P sec.

5. The electrophotographic photosensitive member of claim 3, wherein said resin or oligomer which is liquid at ordinary temperature is at least one member selected from the group consisting of epoxy resin, urethane resin, and acrylate oligomer which are liquid at ordinary temperature.

6. The electrophotographic photosensitive member of claim 1, wherein said composition is thermosetting.

7. The electrophotographic photosensitive member of claim 1, wherein said electro-conductive powder is of at least one metal or alloy selected from the group consisting of aluminum, nickel, copper, silver, and alloys of these metals.

8. The electrophotographic photosensitive member of claim 1, wherein said electro-conductive powder is of carbon.

9. The electrophotographic photosensitive member of claim 1, wherein said electro-conductive powder is of at least one metal oxide selected from the group consisting of antimony oxide, tin oxide, titanium oxide, aluminum oxide, and zinc oxide.

10. The electrophotographic photosensitive member of claim 1, wherein said electro-conductive powder is a barium sulfate or barium carbonate powder.

11. The electrophotographic photosensitive member of claim 1, wherein said electro-conductive powder is a titanium oxide powder having a tin oxide coating layer around the particle thereof.

12. The electrophotographic photosensitive member of claim 11, wherein said tin oxide coating layer contains antimony oxide.

13. The electrophotographic photosensitive member of claim 1, wherein a polyamide resin layer or a phenolic resin layer is interposed between the hardened coating layer and the photosensitive layer.

14. The electrophotographic photosensitive member of claim 13, wherein the polyamide resin is a copolymerized nylon or a type 8 nylon.

15. The electrophotographic photosensitive member of claim 13, wherein the phenolic resin is a resol type of phenolic resin soluble in alcohol.

16. The electrophotographic photosensitive member of claim 1, wherein said substrate is made of aluminum in cylindrical form.

17. The electrophotographic photosensitive member of claim 16, wherein the surface of the aluminum is coarse.

18. The electrophotographic photosensitive member of claim 1, wherein said photosensitive layer comprises a laminate of a charge generation layer and a charge transport layer.

19. The electrophotographic photosensitive member of claim 1, wherein the weight ratio of said electro-conductive powder to the resin being liquid at ordinary temperature is in the range of from 5:1 to 1:5.

20. The electrophotographic photosensitive member of claim 1, wherein the thickness of said hardened coating film is from 1 to 30μ.

21. An electrophotographic photosensitive member for an electrophotographic device provided with a laser as a light source, said photosensitive member comprising a substrate having reflective surface, a photosensitive layer, and an intermediate layer interposed therebetween, characterized in that the intermediate layer is a hardened coating film formed from a liquid dispersion comprising (a) an electro-conductive powder adaptive to lower the electrical resistance of the intermediate layer and (b) a composition which contains either a resin or an oligomer and a crosslinking agent and is liquid at ordinary temperature in the absence of solvent.

22. The electrophotographic photosensitive member of claim 21, wherein the hardened coating film has the effect of scattering a laser beam.

23. The electrophotographic photosensitive member of claim 21, wherein said electro-conductive powder is of at least one metal or alloy selected from the group consisting of aluminum, nickel, copper, silver, and alloys of these metals.

24. The electrophotographic photosensitive member of claim 21, wherein said electro-conductive powder is of carbon.

25. The electrophotographic photosensitive member of claim 21, wherein said electro-conductive powder is of at least one metal oxide selected from the group consisting of antimony oxide, tin oxide, titanium oxide, aluminum oxide, and zinc oxide.

26. The electrophotographic photosensitive member of claim 21, wherein said electro-conductive powder is a barium sulfate or barium carbonate powder.

27. The electrophotographic photosensitive member of claim 21, wherein said electrophotographic device is a laser beam printer.

28. An electrophotographic photosensitive member having at least a substrate, a photosensitive layer, and an intermediate layer therebetween, characterized in that the intermediate layer is a hardened coating film formed from a dispersion liquid comprising (a) an electro-conductive powder adaptive to lower the electrical resistance of the intermediate layer, (b) an acrylate or methacrylate oligomer, and (c) a compound having an acryloyloxy or methacryloyloxy group and a carboxyl group.

29. The electrophotographic photosensitive member of claim 28, wherein said acrylate or methacrylate oligomer is liquid at ordinary temperature in the absence of solvent.

30. The electrophotographic photosensitive member of claim 28, wherein the molecular weight of said acrylate or methacrylate oligomer is no more than $1\times10^4$.

31. The electrophotographic photosensitive member of claim 28, wherein said liquid dispersion contains a polymerization initiator.

32. The electrophotographic photosensitive member of claim 28, wherein said liquid dispersion is thermosetting.

33. The electrophotographic photosensitive member of claim 28, wherein said liquid dispersion is electrocurable.

34. The electrophotographic photosensitive member of claim 28, wherein said liquid dispersion is photocurable.

35. The electrophotographic photosensitive member of claim 28, wherein the weight ratio of said electro-conductive powder to said acrylate or methacrylate oligomer is from 5:1 to 1:5.

36. The electrophotographic photosensitive member of claim 28, wherein said electro-conductive powder is of at least one metal or alloy selected from the group consisting of aluminum, nickel, copper, silver, and alloys of these metals.

37. The electrophotographic photosensitive member of claim 28, wherein said electro-conductive powder is of carbon.

38. The electrophotographic photosensitive member of claim 28, wherein said electro-conductive powder is of at least one metal oxide selected from the group consisting of antimony oxide, tin oxide, titanium oxide, aluminum oxide, and zinc oxide.

39. The electrophotographic photosensitive member of claim 28, wherein said electro-conductive powder is a barium sulfate or barium carbonate powder.

40. The electrophotographic photosensitive member of claim 28, wherein said electro-conductive powder is a titanium oxide powder having a tin oxide coating layer around the particle thereof.

41. The electrophotographic photosensitive member of claim 40, wherein said tin oxide coating layer contains antimony oxide.

42. The electrophotographic photosensitive member of claim 28, wherein a polyamide resin or phenolic resin layer is interposed between the hardened coating film and the photosensitive layer.

43. The electrophotographic photosensitive member of claim 42, wherein said polyamide resin is a copolymerized nylon or a type 8 nylon.

44. The electrophotographic photosensitive member of claim 42, wherein said phenolic resin is a resol type of phenolic resin soluble in alcohol.

45. An electrophotographic photosensitive member for an electrophotographic device provided with a laser as a light source, said photosensitive member comprising a substrate having reflective surface, a photosensitive layer, and an intermediate layer interposed therebetween, characterized in that the intermediate layer is a hardened coating film formed from a liquid dispersion comprising (a) an electro-conductive powder adaptive to lower the electrical resistance of the intermediate layer, (b) an acrylate or methacrylate oligomer, and (c) a compound having an acryloyloxy or methacryloyloxy group and a carboxyl group.

46. The electrophotographic photosensitive member of claim 45, wherein the hardened coating film has the effect of scattering a laser beam.

47. The electrophotographic photosensitive member of claim 45, wherein said electro-conductive powder is of at least one metal or alloy selected from the group consisting of aluminum, nickel, copper, silver, and alloys of these metals.

48. The electrophotographic photosensitive member of claim 45, wherein said electro-conductive powder is of carbon.

49. The electrophotographic photosensitive member of claim 45, wherein said electro-conductive powder is of at least one metal oxide selected from the group consisting of antimony oxide, tin oxide, titanium oxide, aluminum oxide, and zinc oxide.

50. The electrophotographic photosensitive member of claim 45, wherein said electro-conductive powder is a barium sulfate or barium carbonate powder.

51. The electrophotographic photosensitive member of claim 45, wherein said electrophotographic device is a laser beam printer.

* * * * *